US009357829B1

(12) United States Patent
Ikier et al.

(10) Patent No.: US 9,357,829 B1
(45) Date of Patent: Jun. 7, 2016

(54) BEACH CUP AND ACCESSORY HOLDER

(71) Applicants: Deanna Lynn Ikier, Pace, FL (US); Tracey Perry Chastain, Pace, FL (US)

(72) Inventors: Deanna Lynn Ikier, Pace, FL (US); Tracey Perry Chastain, Pace, FL (US)

( * ) Notice: Subject to any disclaimer, the term of this patent is extended or adjusted under 35 U.S.C. 154(b) by 0 days.

(21) Appl. No.: 14/329,899

(22) Filed: Jul. 12, 2014

(51) Int. Cl.
*A45F 3/44* (2006.01)
*A45F 3/46* (2006.01)
*A47G 23/02* (2006.01)

(52) U.S. Cl.
CPC ... *A45F 3/44* (2013.01); *A45F 3/46* (2013.01); *A47G 23/0225* (2013.01); *A45F 2200/0583* (2013.01)

(58) Field of Classification Search
CPC ..... A45F 3/44; A45F 3/46; A47G 23/0225
USPC ..... 248/156; 220/737; D7/620
See application file for complete search history.

(56) References Cited

U.S. PATENT DOCUMENTS

| | | | | | |
|---|---|---|---|---|---|
| 3,627,394 | A | | 12/1971 | Benn | |
| 4,334,661 | A | | 6/1982 | Pitt | |
| D286,591 | S | | 11/1986 | Russell | |
| D307,692 | S | | 5/1990 | Shoup | |
| D308,802 | S | | 6/1990 | Ward | |
| D325,678 | S | | 4/1992 | Niles | |
| D337,487 | S | | 7/1993 | Ramsey et al. | |
| 5,457,918 | A | * | 10/1995 | Plourde | 52/165 |
| D366,600 | S | | 1/1996 | Laskowski et al. | |
| 5,497,902 | A | * | 3/1996 | Crock | 220/737 |
| 5,570,863 | A | | 11/1996 | Cooper | |
| 5,706,975 | A | * | 1/1998 | Cronk | 220/737 |
| D396,383 | S | | 7/1998 | Hanson | |
| D399,707 | S | * | 10/1998 | Villarreal et al. | D7/607 |
| 5,823,496 | A | | 10/1998 | Foley et al. | |
| 5,881,495 | A | * | 3/1999 | Clark | 47/48.5 |
| 5,915,561 | A | * | 6/1999 | Lorenzana et al. | 206/562 |
| 6,098,805 | A | * | 8/2000 | Kent | 206/518 |
| D437,151 | S | * | 2/2001 | Gerstmar | D3/313 |
| 6,199,569 | B1 | * | 3/2001 | Gibson | 135/16 |
| D446,698 | S | * | 8/2001 | Thomas | D7/701 |
| D447,024 | S | * | 8/2001 | Thomas | D7/701 |
| 6,474,015 | B1 | * | 11/2002 | Lund et al. | 43/124 |
| 6,575,417 | B1 | | 6/2003 | Krommenakker | |
| 6,631,527 | B2 | | 10/2003 | Hyduk | |
| 6,732,985 | B1 | | 5/2004 | Cantrell | |
| D494,429 | S | | 8/2004 | Tuite et al. | |
| D498,418 | S | * | 11/2004 | Wickenhauser | D9/455 |
| 6,810,630 | B2 | * | 11/2004 | Chizmas | 52/155 |
| D500,234 | S | * | 12/2004 | Seward | D7/708 |
| 6,945,502 | B2 | * | 9/2005 | Restifo | 248/146 |
| D516,393 | S | * | 3/2006 | Wickenhauser | D7/701 |
| D522,241 | S | * | 6/2006 | Young et al. | D3/305 |
| D527,231 | S | | 8/2006 | Perotti et al. | |
| D549,525 | S | | 8/2007 | Kozel et al. | |
| D550,071 | S | * | 9/2007 | Powell et al. | D8/387 |
| D557,929 | S | * | 12/2007 | Loggins et al. | D6/682.2 |

(Continued)

*Primary Examiner* — Eret McNichols
(74) *Attorney, Agent, or Firm* — Peter Loffler

(57) ABSTRACT

A ground insertable holder has a first compartment that has a cylindrical inner space that holds a typical beverage container and a second compartment that holds various accessories, such as cell phones, snacks, etc. The device is ground secured by screwing the device into the ground via a screw that extends downwardly from the bottom of the device. An optional second beverage container holder can be removably attached to a mount located on the bottom of the device. The second compartment may be unitary and possibly monolithic with the first compartment or may be removably attached thereto.

17 Claims, 7 Drawing Sheets

(56) References Cited

U.S. PATENT DOCUMENTS

| | | | | |
|---|---|---|---|---|
| 7,309,198 | B1 * | 12/2007 | Brown | 410/101 |
| 7,516,931 | B2 | 4/2009 | Sarullo | |
| 7,673,588 | B2 * | 3/2010 | Head | 119/786 |
| D618,074 | S | 6/2010 | Paetsch | |
| D618,968 | S | 7/2010 | Belden | |
| D643,253 | S | 8/2011 | Cilmi | |
| D657,633 | S | 4/2012 | Butler | |
| 8,474,773 | B2 | 7/2013 | Hull | |
| D705,013 | S | 5/2014 | Audibert | |
| D721,929 | S * | 2/2015 | Lueker | D7/701 |
| D725,445 | S * | 3/2015 | Braithwaite | D7/701 |
| 2003/0019034 | A1 * | 1/2003 | Hyduk | 5/417 |
| 2004/0129184 | A1 * | 7/2004 | Kraker | 108/50.12 |
| 2008/0017765 | A1 | 1/2008 | Kirkendall | |
| 2012/0199705 | A1 | 8/2012 | Will | |
| 2014/0048550 | A1 * | 2/2014 | Marcades et al. | 220/737 |
| 2015/0001266 | A1 * | 1/2015 | Pluta | 224/281 |
| 2015/0060474 | A1 * | 3/2015 | Drury et al. | 220/738 |
| 2015/0068433 | A1 * | 3/2015 | Nardi | 108/25 |

* cited by examiner

BEACH CUP AND ACCESSORY HOLDER

BACKGROUND OF THE INVENTION

1. Field of the Invention

The present invention relates to a ground insertable cup holder that has a separate accessory holder.

2. Background of the Prior Art

There are not many better ways to spend a summer day than going to the beach. Spread out a blanket, put on some lotion, soak up the sun, enjoy the warm waters, and people watch, it simply does not get much better. During extended visits at the beach, and even during short visits, beach goes tend to get thirsty. In addressing such thirst, the enjoyment of a cool refreshing beverage, including a refreshing adult beverage, adds to the overall enjoyment of the beach experience. Just crack open a can or bottle (where permitted) and enjoy. The problem is that most people do not drink an entire can or bottle in a single shot, rather they prefer to sip on the beverage, especially if the beverage container is relatively large. The problem becomes what to do with the half consumed beverage. Placing the beverage container down on the ground may seem straightforward, but the probability of knocking the container over on the uneven sand is quite high, especially by a beachgoers half asleep in the warm sun. Some beachgoers partially bury the container in the sand to help prevent knocking the container over. However, not only does this increase the potential for getting sand into the container, substantial effort must be realized each time a drink is desired from the container.

To address this problem, devices have been proposed whereby a beverage container is held relatively securely while minimizing the risk of sand intrusion into the container, such that retrieval of the container to extract a sip therefrom, is relatively easy, as is replacement of the container back into its holder. Such devices, which come in a variety of architectures, have a typical cylindrical receptacle that removably holds the beverage container and an appropriate ground stake extending downwardly from the bottom of the receptacle, which ground stake is driven into the sandy ground of the beach and helps hold the device secure and upright. In use, the person drives the device into the ground, places the beverage container into the receptacle and withdraws the beverage container each time a drink is desired.

While effective, these devices fail to address other needs of modern beachgoers. Many beachgoers have other paraphernalia that they require to have ready at hand without the need to to fumble about a beach bag for such paraphernalia. Such items include smart phones and music players as well as snacks and juice boxes for little beachgoers that can get fussy at a moment's notice. While multiple beverage containers can be deployed to address this problem, many beachgoers find such multiple deployments to be awkward and inconvenient. Additionally, the cylindrical inside space of such holders is not the most ideal for the non-beverage container items that need to be held immediately at hand.

What is needed is a single unitary device that allows a beach goer to securely hold a beverage container as well as other paraphernalia that is needed immediately at hand by the beach goer, without the need to deploy multiple securement devices. Such a device must be relatively simple in operation so that ground securement of the device is easy and straightforward and so that insertion of various items, including the beverage container, into and extraction from the device is essentially effortless. Such a device must be of relatively simple design so that it is readily affordable by a large segment of potential consumers for this type of device.

SUMMARY OF THE INVENTION

The beach cup and accessory holder of the present invention addresses the aforementioned needs in the art by providing a device that securely holds a typical beverage container in the usual way and also has a separate storage area for other items, such as smart phones, snacks, etc., all such items being easily retrievable from the device. The separate storage area is unitary, and possibly monolithic with the beverage container proper. The beach cup and accessory holder is relatively easy to use in all its facets of operation, including ground securement of the device, storage of items within the device, and retrieval of items from the device. The beach cup and accessory holder is of relatively simple design and construction, to being produced using standard manufacturing techniques, so that the device is relatively inexpensive to produce so as to be economically attractive to a large segment of potential consumers for this type of device.

The beach cup and accessory holder of the present invention is comprised of a first compartment that has a first closed bottom and a first open top and a generally cylindrical inner side wall. A second compartment has a second closed bottom and a second open top and is attached to an outer side wall of the first compartment. A ground securement device extends downwardly from the first closed bottom of the first compartment and/or the second closed bottom of the second compartment. The ground securement device may be attached to the first bottom and/or second bottom via a mount. An optional beverage container holder that has an open top is removably attached to the mount. The ground securement device may be a threaded screw. The second compartment has a back wall that is disposed opposite the outer side wall of the first compartment such that an inner surface of the back wall is flat. The second compartment may be removably attached to the first compartment or may be unitary, possibly monolithic with the first compartment. An insulation layer may be attached to the inner side wall of the first compartment. A first drain opening is located in the first bottom of the first compartment while a second drain opening located in the second bottom of the second compartment.

BRIEF DESCRIPTION OF THE DRAWINGS

Similar reference numerals refer to similar parts throughout the several views of the drawings.

DESCRIPTION OF THE PREFERRED EMBODIMENT

Figure 1:
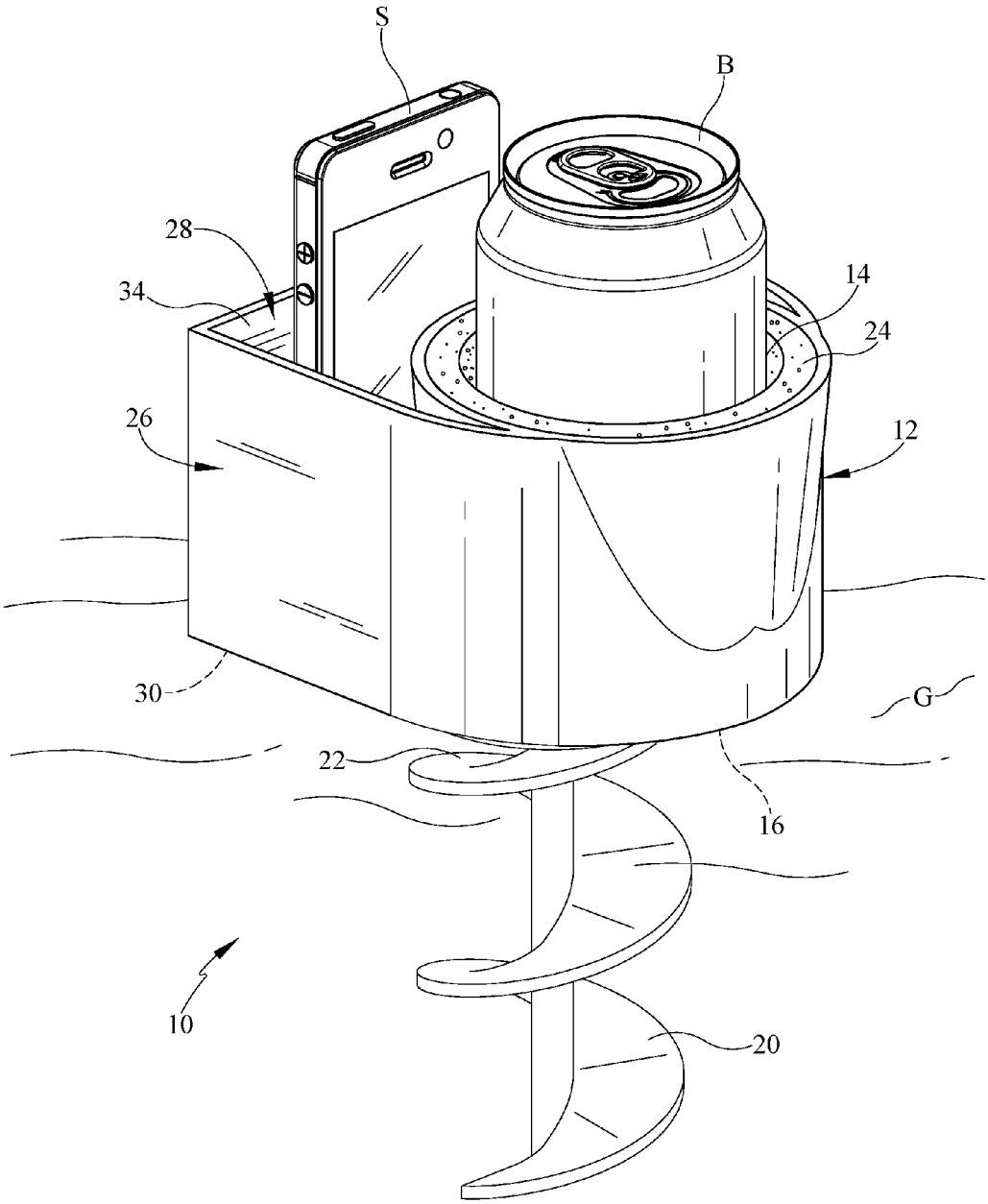
FIG. 1 is an environmental view of the beach cup and accessory holder of the present invention secured within a ground surface.
Figure 2:
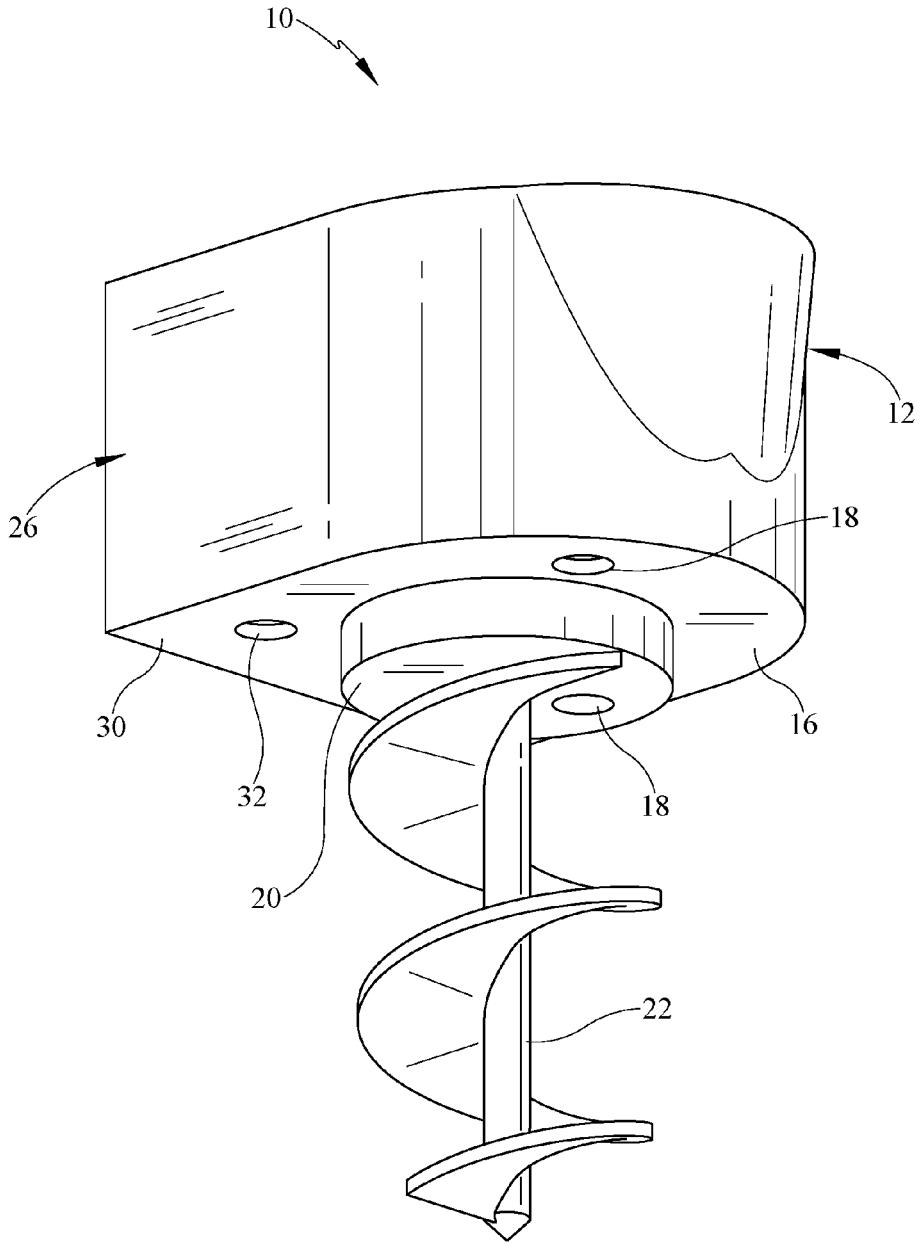
FIG. 2 is a perspective view of the beach cup and accessory holder.
Figure 3:
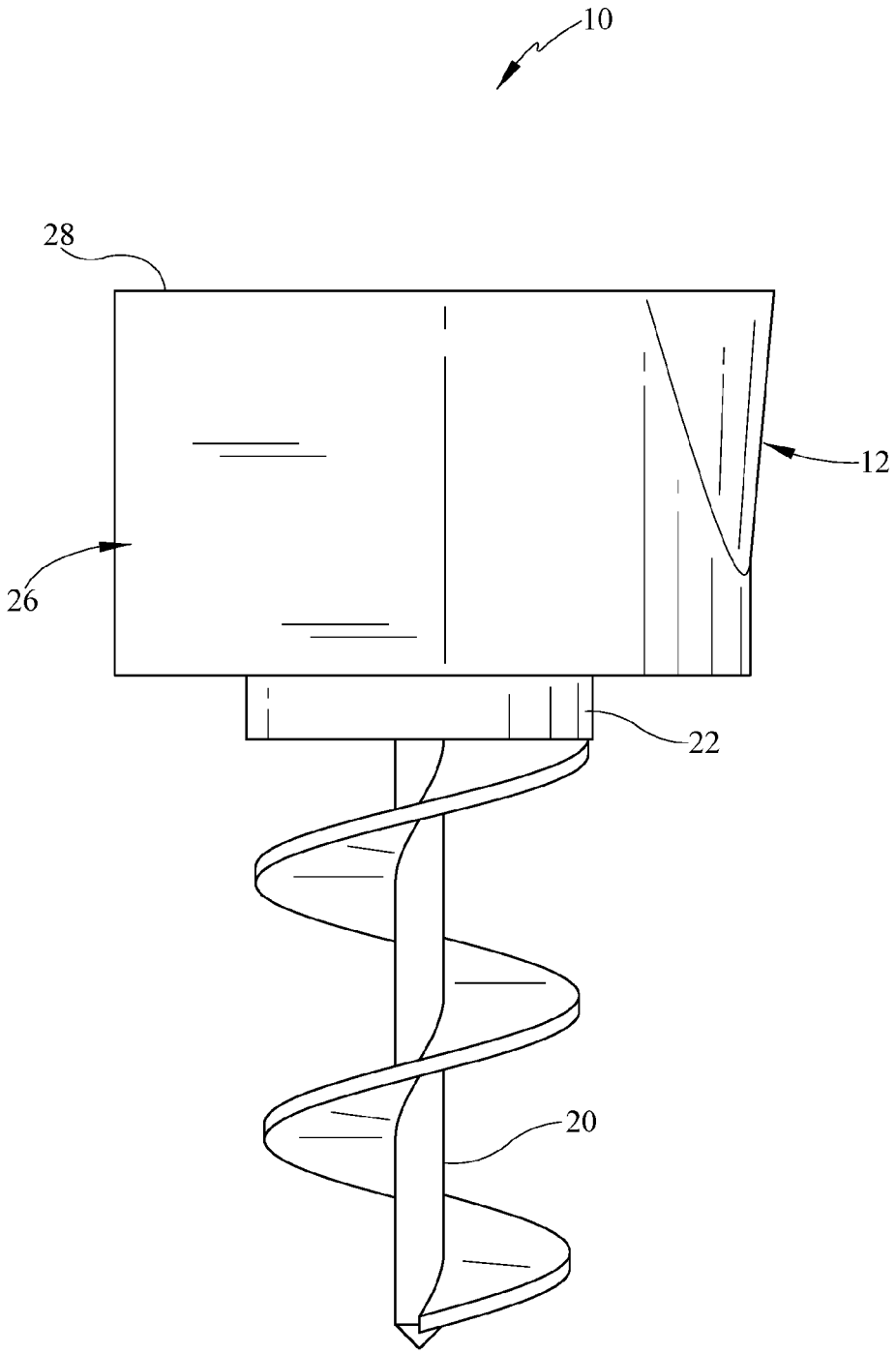
FIG. 3 is a side elevation view of the beach cup and accessory holder.

Referring now to the drawings, it is seen that the beach cup and accessory holder of the present invention, generally denoted by reference numeral 10, is comprised of a generally cylindrical primary beverage container holder 12 that has an open top 14 and a closed bottom 16 with one or more drain openings 18 located thereon. A threaded screw 20 extends downwardly from the bottom 16 of the device, possibly from primary beverage container holder 12, and possibly from an optional raised mount 22. As seen, the inner surface of the primary beverage container holder 12 can have an insulated layer 24 secured therein in any appropriate fashion, such as via adhesion, although this insulation layer 24 may simply be friction held within the interior space of the primary beverage container holder 12 for ease of replacement as the insulation layer 24 becomes torn.

Extending outwardly from the side of the beverage container holder is an accessory holder 26 that also has an open top 28 and a closed bottom 30 with one or more drain holes 32 located on the bottom 30. Advantageously, although not necessarily, the inner surface of the back wall 34 of the accessory holder 26—the wall 34 opposite the primary beverage container holder 12 is substantially flat in order to properly holder typical flat items to be held within the accessory holder 26 such as the illustrated cell phone S. The screw 20 and mount 22, if used, may be partially or fully extend from the second closed bottom 30.

The beverage container 12 and the accessory holder 26 are each made from an appropriate material, such as a lightweight plastic, and can be unitary in construction, indeed monolithic. The threaded screw 20 including the mount 22, if provided, may also be made from the same or similar materials used to make the primary beverage container holder 12 and accessory holder 26. The threaded screw 20 and mount 22, if provided, may also be formed unitarily and possibly monolithically with the primary beverage container holder 12 and accessory holder 26, although for ease of manufacture, the threaded screw 20 and mount may be formed as a separate unit (unitary and possibly monolithic with each other) or units and thereafter permanently attached to the underside of the primary beverage container holder 12 and/or accessory holder 26 in appropriate fashion such as via adhesion or welding.

Figure 6:
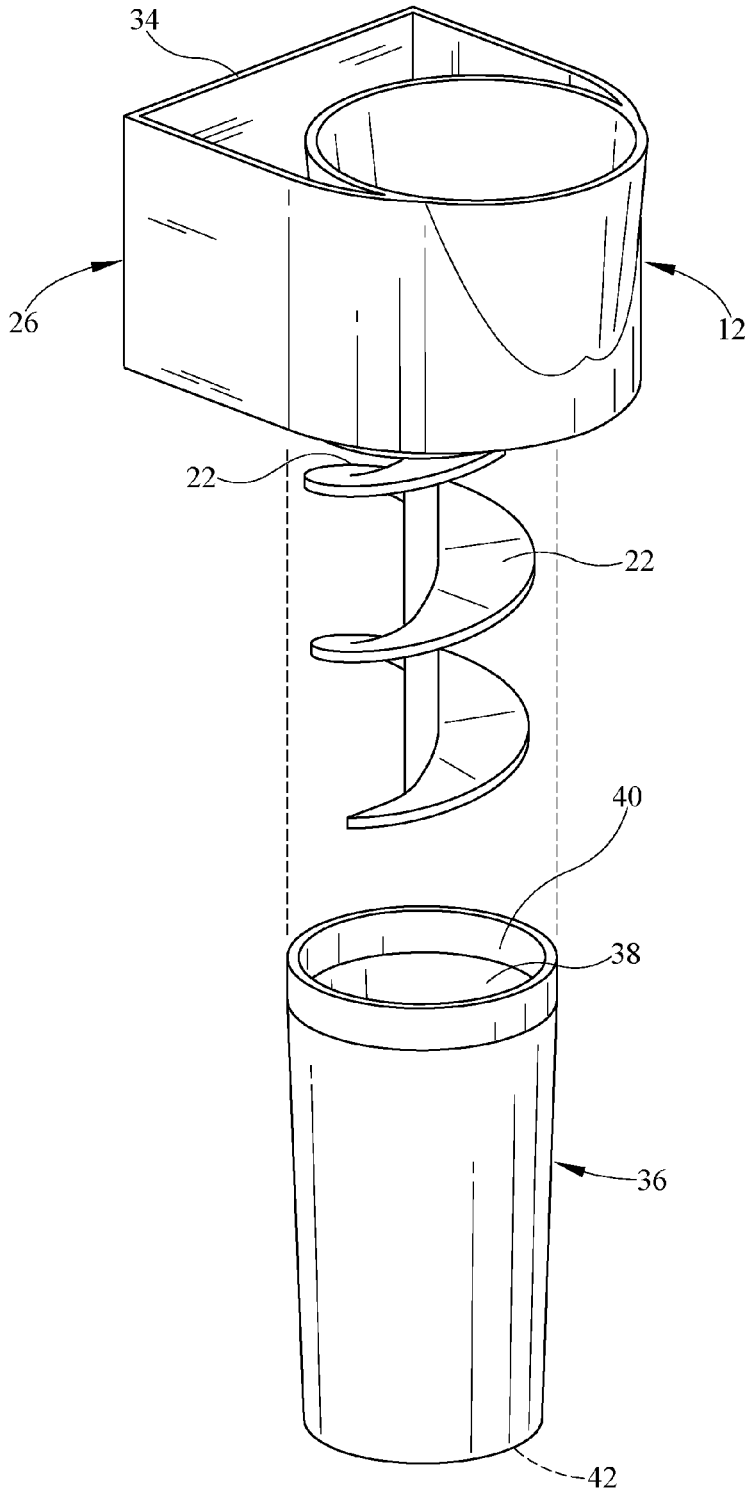
FIG. 6 is a perspective view of the beach cup and accessory holder illustrating the secondary beverage container holder.

As seen in FIG. 6, an optional secondary beverage container holder 36 has an open top 38 with an inside annular edge 40 and a closed bottom 42, possibly with one or more drain holes (not illustrated) therein. The secondary beverage holder 36 is removably attached to the beach cup and accessory holder 10 by pushing the open top 38 of the secondary beverage container holder 36 onto the mount 22. The mount 22 and the inside diameter of the annular edge 40 of the secondary beverage holder 36 are each dimensioned so that the annular edge 40 of the secondary beverage container holder 36 is friction held on the mount 22. When use of the secondary beverage container holder 36 is needed, such as when a user is on his or her way to the beach from the condo and the beach cup and accessory holder 10 is not yet ground G secured, the secondary beverage container holder 36 is pulled apart from the mount 22 and the beverage container B is placed into the secondary beverage container holder 36. Once use of the secondary beverage container 36 is not needed, such as at the end of the day when the beach cup and accessory holder 10 is unsecured from the ground G, the secondary beverage container holder 36 is pushed back onto the mount 22. Alternately, the secondary beverage container holder 36 can be threadably secured to the mount 22 as is well known in the art. The secondary beverage container holder 36 can be made from the same or similar materials used to form at least the primary beverage container holder 12 and accessory holder 26 and may also have an insulated layer (not illustrated) or may be formed to have insulation properties.

Figure 4:
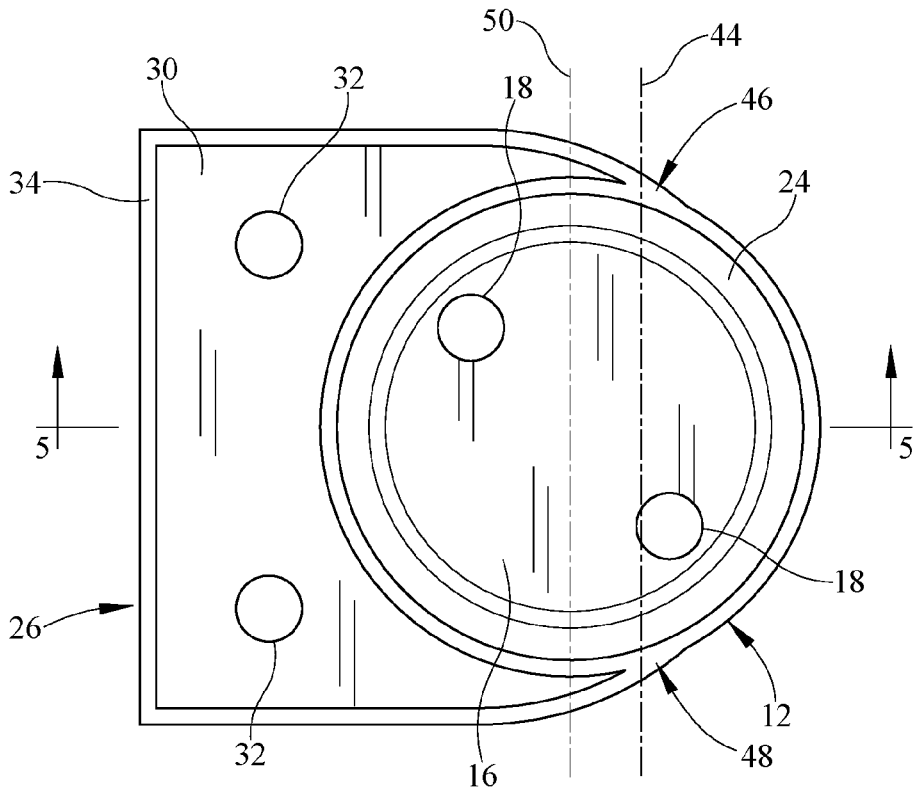
FIG. 4 is a top plan view of the beach cup and accessory holder.
Figure 5:
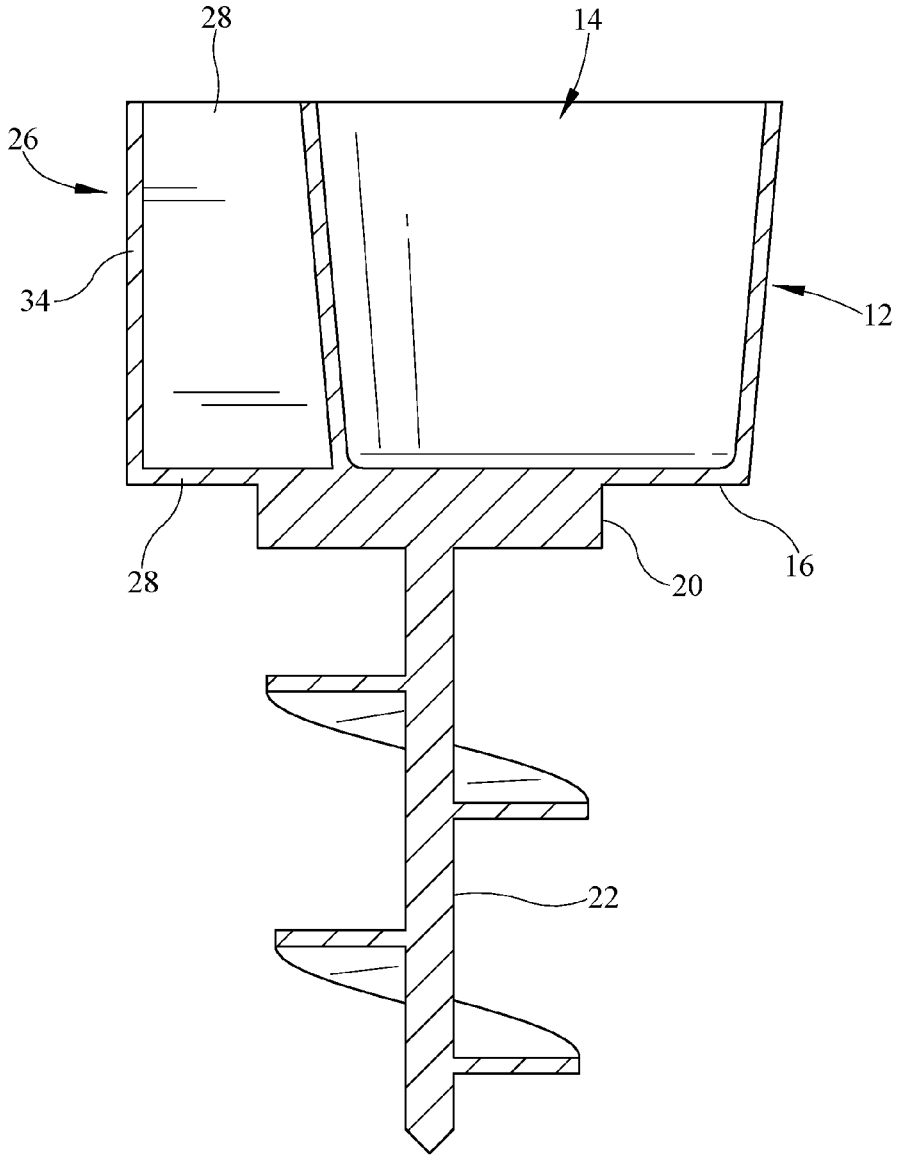
FIG. 5 is a sectioned view of the beach cup and accessory holder taken along line 5-5 in FIG. 4.

As seen in FIG. 4, the wall second compartment 26 extends from a first linear area 46 of the wall of the first compartment 12 and from an opposing second linear area 48 of the wall of the first compartment 12 such that a line extends between the first linear area 46 and the second linear area 48 and passes through the interior volume of the first compartment 12. This line 44 is parallel to, and spaced apart from a diameter 50 that bisects the interior volume of the first compartment 12 such that this diameter 50 is positioned between the line 44 and the back wall 34 of the second compartment 26.

In order to use the beach cup and accessory holder 10 of the present invention, the secondary beverage container holder 36, if provided, is removed from the mount 22 and used if desired. The primary beverage container holder 12 and accessory holder 26 are secured to the ground G by screwing the unit into the ground G via the threaded screw 20 to a desired depth. Of course, instead of a threaded screw 20, a stake can extend from the bottom of the beach cup and accessory holder 10 in order to provide ground securement means to the beach cup and accessory holder 10. Once the device is secured, a beverage container B can be placed into the primary beverage container holder 12 and any desired accessories S can be placed into the accessory holder 26. Of course, if provided, the secondary beverage container holder 36 can also be coincidentally used, possibly by another user or during beach walks. At the end of the beach day, the unit (primary beverage container holder 12 and accessory holder 26) is unscrewed from the ground G and, if provided and desired, the secondary beverage container holder 36 is attached back onto the mount 22.

Figure 7:
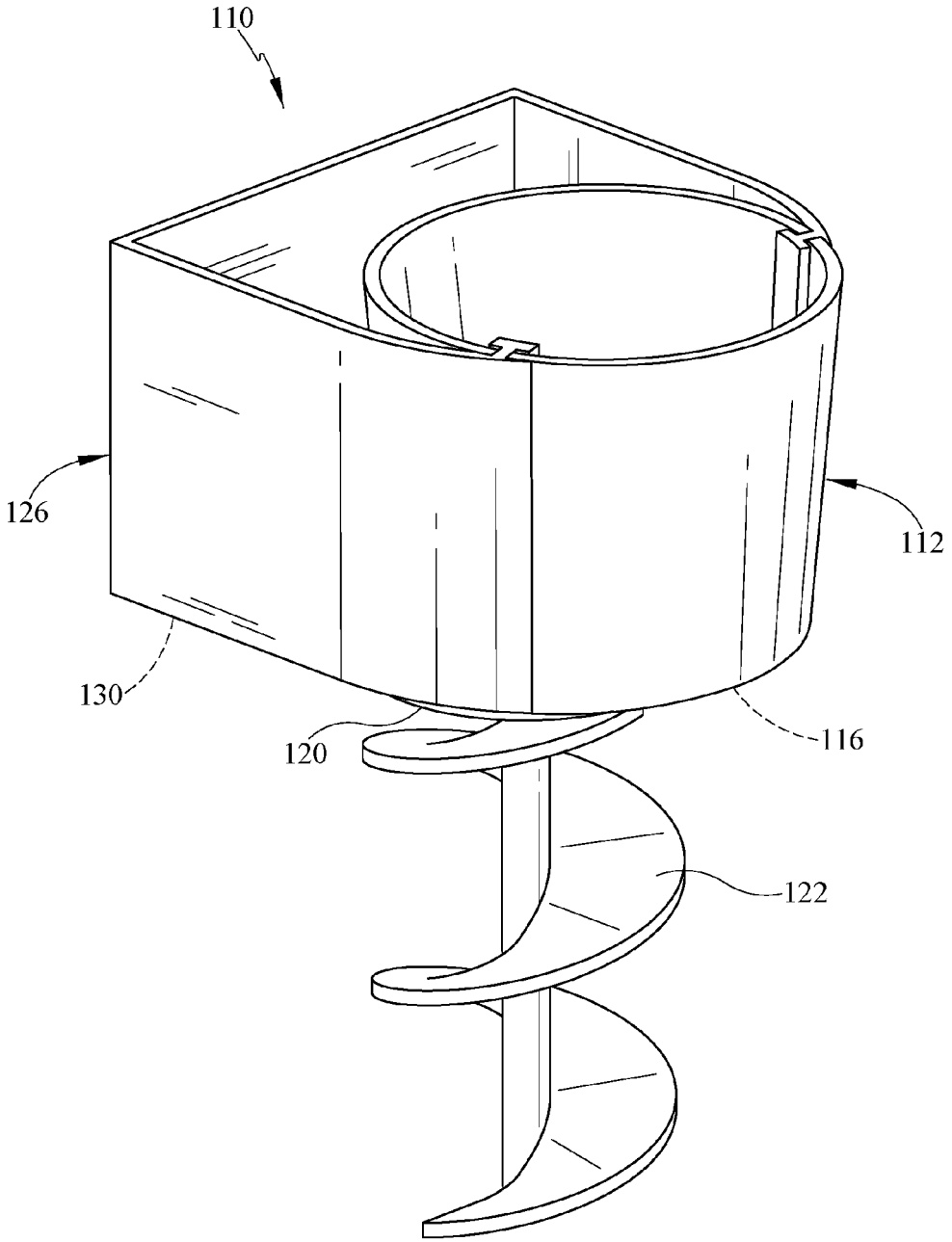
FIG. 7 is a perspective view of the beach cup and accessory holder illustrating the removable attachment of the accessory holder attached to the beverage container holder.

As seen in FIG. 7, the beach cup and accessory holder 110 can be constructed so that the accessory holder 126 is removably attached to the primary beverage container holder 112 in appropriate fashion. In all other respects, this embodiment of the beach cup and accessory holder 110 is substantially similar to the first embodiment of the beach cup and accessory holder 10, in that this embodiment also has a threaded screw 120 (or stake) extending downwardly from a closed bottom 116 of the primary beverage holder 112 and/or accessory holder 126, possibly via the optional mount 122. Drain openings (neither illustrated) are provided in both the bottom 116 of the primary beverage container holder 112 and the bottom 130 of the accessory holder 126. A secondary beverage container holder (not illustrated) can be removably attached to the mount 122 in appropriate fashion. The various components of this embodiment of the beach cup and accessory holder 110 can be made from the same or similar materials used to make the corresponding components of the first embodiment of the beach cup and accessory holder 10. This embodiment of the beach cup and accessory holder 110 functions identically to the first embodiment of the beach cup and accessory holder 10, except that the accessory holder 126 is removably attachable to the primary beverage container holder 112. Having the accessory holder 126 removably attachable to the primary beverage container holder 112 slightly increases the complexity of manufacture of the device, however, the benefits are that if the accessory holder 126 is not needed for a given outing, it need not be brought along. Additionally, various sizes of accessory holders 126 can be provided so that if a user wants the accessory holder 126 to hold a tablet instead of a cell phone, then a relatively larger accessory holder is attached to the primary beverage container holder 112.

While the invention has been particularly shown and described with reference to embodiments thereof, it will be appreciated by those skilled in the art that various changes in form and detail may be made without departing from the spirit and scope of the invention.

We claim:

1. A multi-compartment holder comprising:

a first compartment having a first closed bottom and a first open top, a first interior volume, and a generally cylindrical first side wall, the first side wall having a first inner surface and a corresponding first outer surface;

a non-rectangular-shaped second compartment having a second closed bottom and a second open top, the second compartment having a second side wall that has a second inner surface and a second outer surface such that the second side wall is attached to and extends outwardly from a first linear area of the first outer surface of the first side wall and from a second linear area of the first outer surface of the first side wall such that an overall inner surface of the second compartment is formed from the second inner surface and a portion of the first outer surface between the first linear area and the second linear area such that the first linear area and the second linear area are spaced apart and discontigous from one another such that a line extends between the first linear area and the second linear area passes through the interior volume of the first compartment and is spaced part from and parallel to a diameter that bisects the interior volume such that the diameter is positioned between the line and the second side wall of the second compartment; and a ground securement device extending downwardly from the first bottom of the first compartment or the second bottom of the second compartment.

2. The multi-compartment holder as in claim 1 wherein the ground securement device is attached to the first bottom or the second bottom via a mount.

3. The multi-compartment holder as in claim 2 further comprising a beverage container holder having an open top, the beverage container removably attached to the mount.

4. The multi-compartment holder as in claim 3 wherein the ground securement device is a threaded screw.

5. The multi-compartment holder as in claim 4 wherein the second compartment has a back wall disposed opposite the portion of the first outer surface between the first linear area and the second linear area of the first compartment such that the back wall is flat.

6. The multi-compartment holder as in claim 5 further comprising an insulation layer attached to the first inner surface of the first compartment.

7. The multi-compartment holder as in claim 6 further comprising a first drain opening located in the first bottom of the first compartment.

8. The multi-compartment holder as in claim 7 further comprising a second drain opening located in the second bottom of the second compartment.

9. The multi-compartment holder as in claim 8 wherein the second compartment is removably attached to the first compartment.

10. The multi-compartment holder as in claim 8 wherein the first compartment and the second compartment are monolithic in construction.

11. The multi-compartment holder as in claim 1 further comprising a beverage container holder having an open top that is removably attached to the first bottom of the first compartment.

12. The multi-compartment holder as in claim 1 wherein the ground securement device is a threaded screw.

13. The multi-compartment holder as in claim 1 wherein the second compartment has a back wall disposed opposite the portion of the first outer surface between the first linear area and the second linear area of the first compartment such that the back wall is flat.

14. The multi-compartment holder as in claim 1 further comprising a first drain opening located in the first bottom of the first compartment.

15. The multi-compartment holder as in claim 14 further comprising a second drain opening located in the second bottom of the second compartment.

16. The multi-compartment holder as in claim 1 wherein the second compartment is removably attached to the first compartment.

17. The multi-compartment holder as in claim 1 wherein the first compartment and the second compartment are monolithic in construction.

* * * * *